US009216452B2

(12) United States Patent
Hwang et al.

(10) Patent No.: US 9,216,452 B2
(45) Date of Patent: Dec. 22, 2015

(54) EDGE DAM UPPER PORTION SEALING APPARATUS FOR TWIN ROLL STRIP CASTER

(71) Applicant: POSCO, Pohang-si (KR)

(72) Inventors: Kwang-Seok Hwang, Pohang-si (KR); Cheol-Min Park, Pohang-si (KR); Oh-Seong Kweon, Pohang-si (KR); Jae-Bong Park, Pohang-si (KR); Byoung-Hoon Kim, Pohang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 14/570,391

(22) Filed: Dec. 15, 2014

(65) Prior Publication Data

US 2015/0174649 A1 Jun. 25, 2015

(30) Foreign Application Priority Data

Dec. 24, 2013 (KR) ..... 10-2013-0163245

(51) Int. Cl.
*B22D 11/06* (2006.01)

(52) U.S. Cl.
CPC ..... *B22D 11/066* (2013.01); *B22D 11/0622* (2013.01)

(58) Field of Classification Search
CPC . B22D 11/06; B22D 11/0622; B22D 11/0666
USPC ..... 164/427–434, 479–482
See application file for complete search history.

(56) References Cited

U.S. PATENT DOCUMENTS

| | | | | |
|---|---|---|---|---|
| 5,368,088 | A * | 11/1994 | Furuya et al. | 164/415 |
| 7,323,135 | B2 * | 1/2008 | Choi et al. | 266/90 |
| 2005/0253314 | A1 | 11/2005 | Choi et al. | |
| 2014/0008032 | A1 | 1/2014 | Ondrovic et al. | |

FOREIGN PATENT DOCUMENTS

| | | | |
|---|---|---|---|
| KR | 10-0584751 | B1 | 5/2006 |
| KR | 2010-0003507 | A | 1/2010 |
| KR | 10-2011-0008618 | A | 1/2011 |

* cited by examiner

*Primary Examiner* — Kevin E Yoon
(74) *Attorney, Agent, or Firm* — The Webb Law Firm

(57) ABSTRACT

There is provided an edge dam upper portion sealing apparatus for a twin roll strip caster. The edge dam upper portion sealing apparatus may include: a sealing pad making tight contact with an upper portion of an edge dam and a lateral side of a meniscus shield of the twin roll strip caster; a bearing member coupled to the sealing pad; and a driving unit connected to the bearing member and coupled to at least two links for forming a link structure.

6 Claims, 6 Drawing Sheets

EDGE DAM UPPER PORTION SEALING APPARATUS FOR TWIN ROLL STRIP CASTER

CROSS-REFERENCE TO RELATED APPLICATION

This application claims the benefit of Korean Patent Application No. 10-2013-0163245 filed on Dec. 24, 2013, with the Korean Intellectual Property Office, the disclosure of which is incorporated herein by reference.

FIELD OF THE INVENTION

The present disclosure relates to an edge dam upper portion sealing apparatus for a twin roll strip caster.

BACKGROUND OF THE INVENTION

In general, twin roll strip casters are used to produce strips having a thickness of several millimeters (mm) by supplying molten steel to a space between a pair of rotating casting rolls.

As shown in FIG. 1, a strip may be produced through a continuous casting process using a twin roll strip caster as follows: molten steel is supplied to a molten steel pool 4 formed by a pair of casting rolls 1, rotated while being cooled with cooling water, and edge dams 2 sealing sides of the casting rolls 1; and thin shells being formed as the molten steel is cooled by contact with the surfaces of the casting rolls 1 are continuously attached at the nip of the casting rolls 1 as a strip having a predetermined thickness.

A meniscus shield 3 is disposed on top of the molten steel pool 4 to block ingress of ambient air, such that molten steel supplied to the molten steel pool 4 may not be oxidized by contact with ambient air, and an inert gas is supplied to the surface of the molten steel through a nozzle installed on the twin roll strip caster for preventing re-oxidation of the molten steel.

Generally, a gas knife or an elastic pad is disposed between the meniscus shield 3 and a center region of the casting rolls 1 to prevent the permeation of ambient air. However, it is relatively difficult to seal both edge portions of the casting rolls 1 because the edge dams 2 may be continuously shaken.

If both edges portions of the casting rolls 1 are not securely sealed as described above, oxides may be formed on the surface of molten steel and may be included in a strip, thereby degrading the quality of edge portions of the strip.

To address this problem, a method of installing sealing members such as elastic pads 5 on top of the edge dams 2 has been proposed as shown in FIGS. 2A and 2B. However, after a long period of use, the elastic pads 5 may be pushed and deformed or separated because of vertical and horizontal shaking of the edge dams 2. In addition, when the elastic pads 5 are excessively compressed by forward movements of the edge dams 2, the edge dams 2 are also excessively stressed.

SUMMARY OF THE INVENTION

An aspect of the present disclosure may provide an edge dam upper portion sealing apparatus for a twin roll strip caster, the edge dam upper portion sealing apparatus being configured to apply constant loads to upper portions of edge dams while moving in synchronization with continuous movements of the edge dams so as to seal gaps between the edge dams and a meniscus shield without applying excessive force to edge dam structures and thus to prevent permeation of ambient air.

According to an aspect of the present disclosure, an edge dam upper portion sealing apparatus for a twin roll strip caster may include: a sealing pad making tight contact with an upper portion of an edge dam and a lateral side of a meniscus shield of the twin roll strip caster; a bearing member coupled to the sealing pad; and a driving unit connected to the bearing member and coupled to at least two links for forming a link structure.

The bearing member may include: a spherical bearing; and an angle having a shape corresponding to the sealing pad for fixing the sealing pad.

The driving unit and the bearing member may be coupled to each other to form the link structure.

The sealing pad may seal a gap between the edge dam and the meniscus shield.

The sealing pad may include: two heat-resistant members attached to each other; a support plate disposed between the two heat-resistant members and including at least one hole formed therein; and a wire having an end coupled to the hole formed in the support plate through one of the two heat-resistant members and the other end exposed externally from the heat-resistant members.

The sealing pad may further include heat-resistant fibers surrounding outer surfaces of the two heat-resistant members.

The other end of the wire may be coupled to the angle of the bearing member, and the sealing pad may be brought into tight contact with the angle.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE INVENTION

Figure 1:
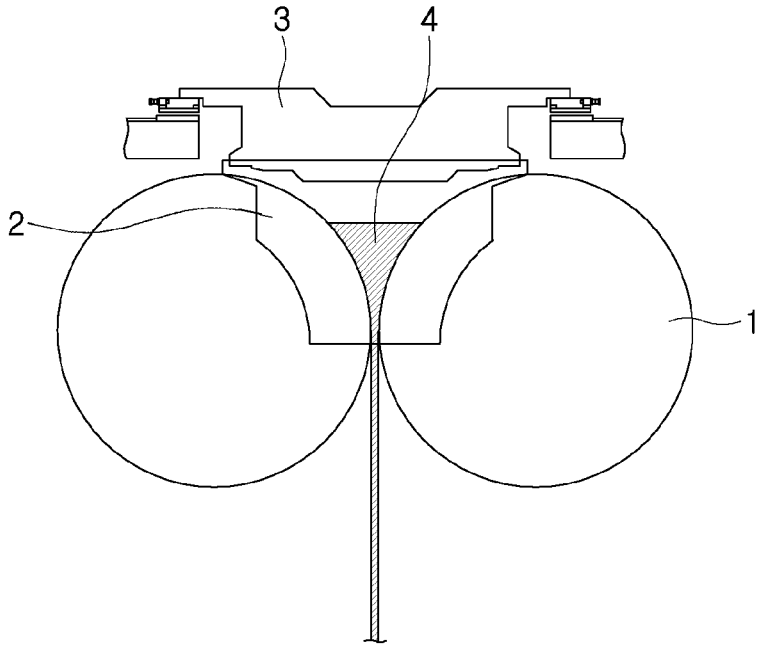
FIG. 1 PRIOR ART
FIG. 1 is a schematic view illustrating a twin roll strip caster of the related art.
Figure 2A:
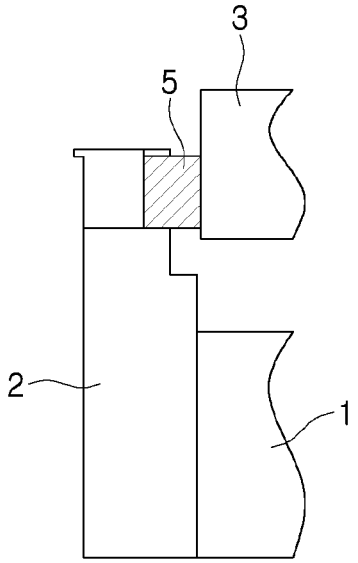
FIG. 2A PRIOR ART
FIGS. 2A and 2B are views illustrating an edge dam upper portion sealing apparatus of the related art.
Figure 2B:
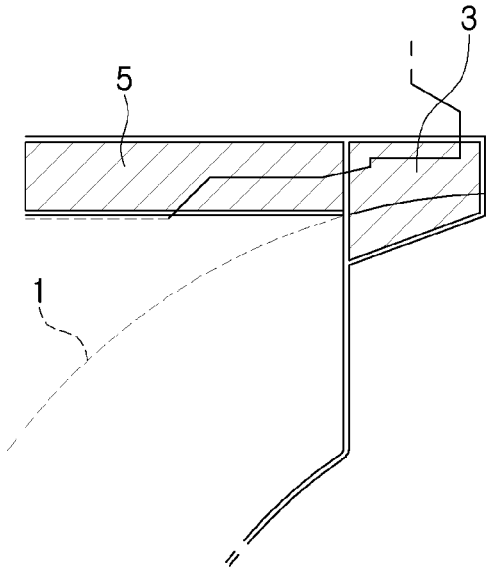
FIG. 2B PRIOR ART

Exemplary embodiments of the present disclosure will now be described in detail with reference to the accompanying drawings. The disclosure may, however, be exemplified in many different forms and should not be construed as being limited to the specific embodiments set forth herein. Rather, these embodiments are provided so that the disclosure will be thorough and complete, and will fully convey the scope of the disclosure to those skilled in the art.

In the following description, terms used for referring to elements are defined according to the functions of the elements and are not intended to limit the elements.

Furthermore, in the present disclosure, when an element is referred to as being "connected to" or "coupled to" another element, it may be directly connected or coupled to the other element or intervening elements may be present. It will be further understood that the terms "comprises" and/or "comprising" used herein specify the presence of stated features or elements, but do not preclude the presence or addition of one or more other features or elements.

In the drawings, the shapes and dimensions of elements maybe exaggerated for clarity, and the same reference numerals will be used throughout to designate the same or like elements.

Figure 3:
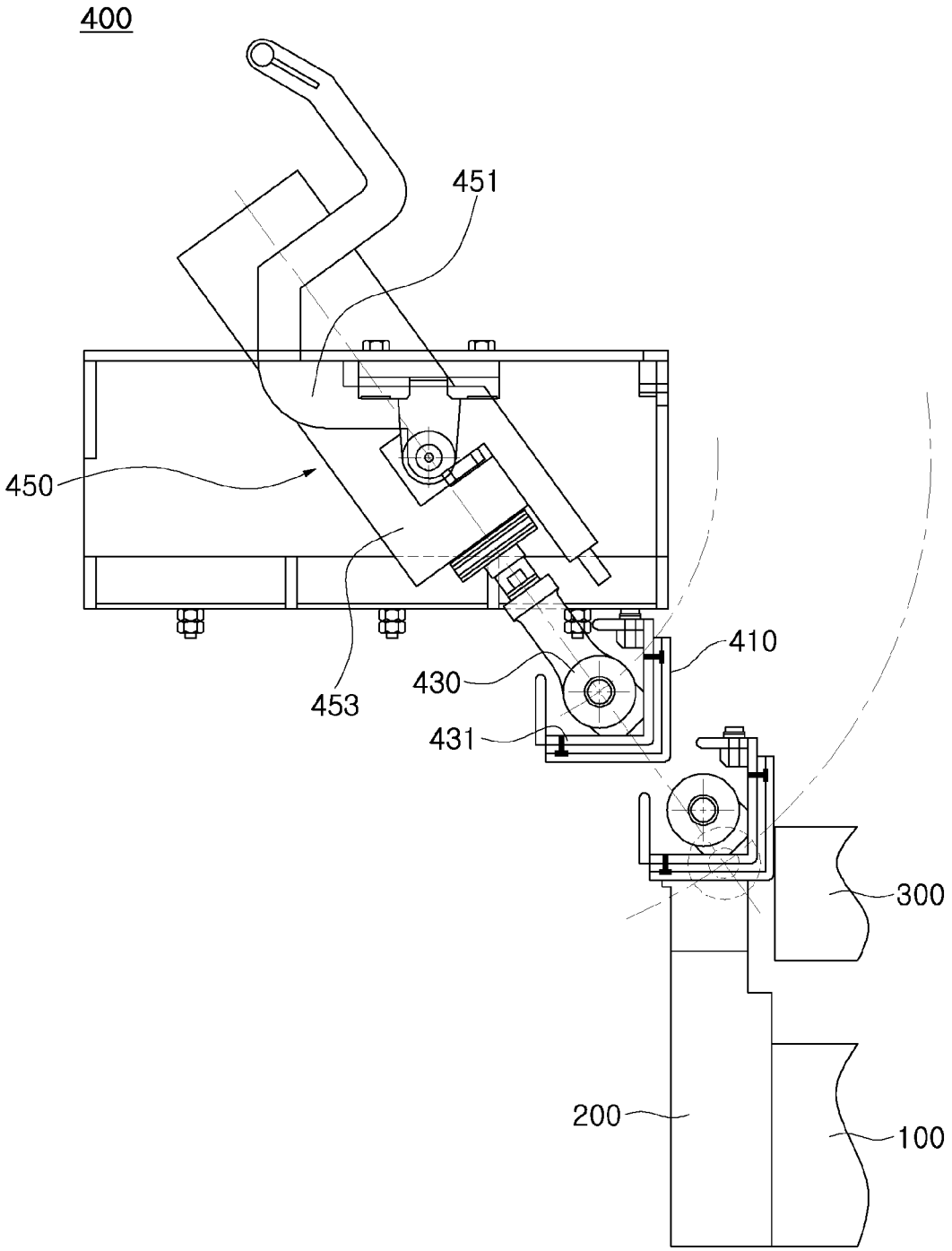
FIG. 3 is a side view illustrating an edge dam upper portion sealing apparatus according to an exemplary embodiment of the present disclosure.
Figure 4A:
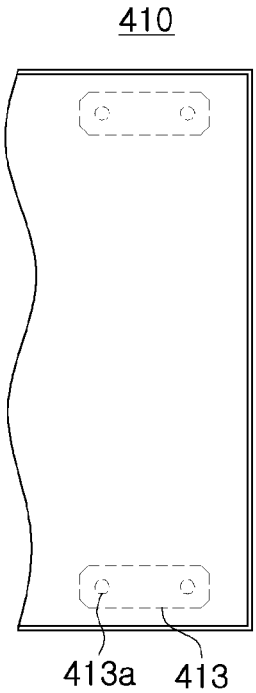
FIGS. 4A and 4B are a front view and a side view illustrating a sealing pad according to an exemplary embodiment of the present disclosure.
Figure 4B:
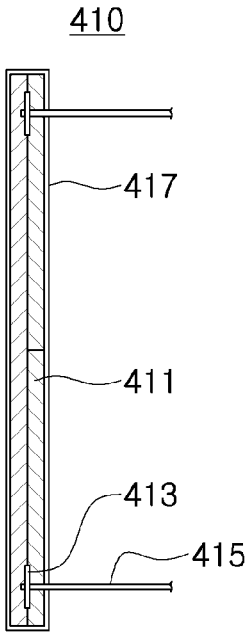
Figure 5:
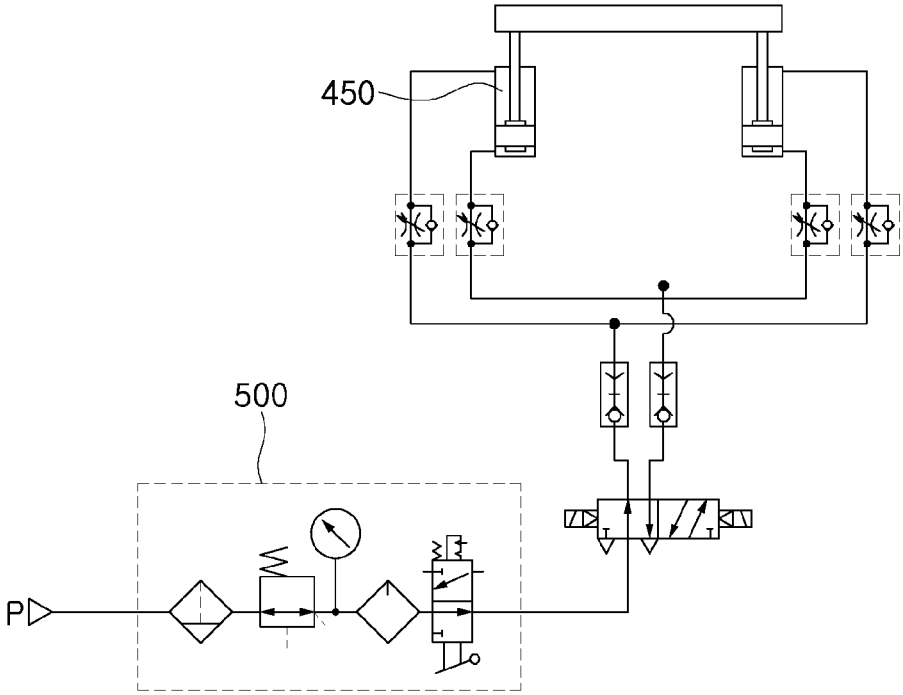
FIG. 5 is a pneumatic circuit diagram according to an exemplary embodiment of the present disclosure.
Figure 6B:
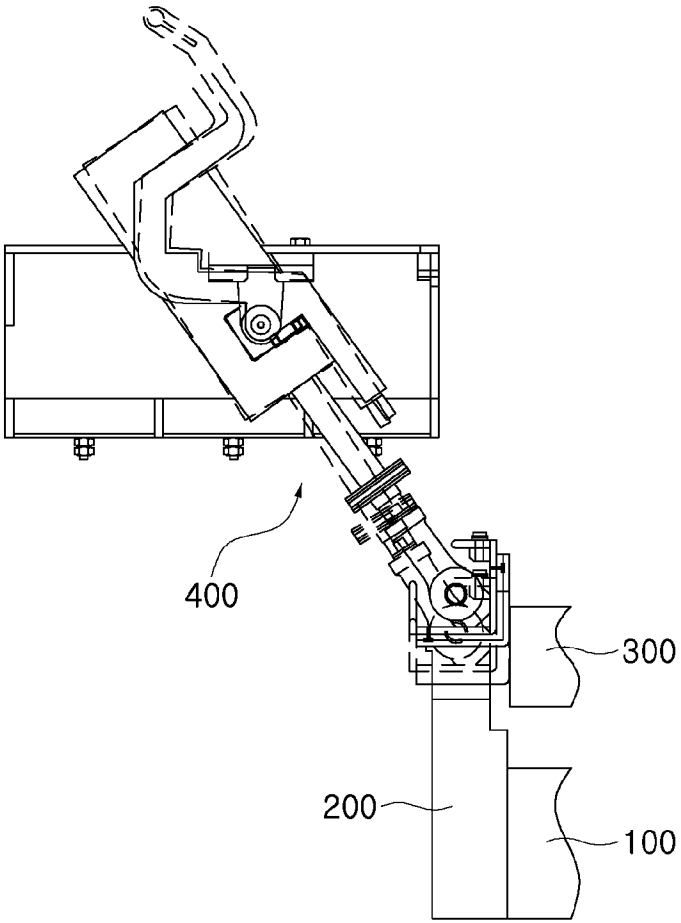
FIGS. 6A and 6B are side views illustrating the edge dam upper portion sealing apparatus moving in synchronization with movements of edge dams of a twin roll strip caster according to an exemplary embodiment of the present disclosure.
Figure 6A:
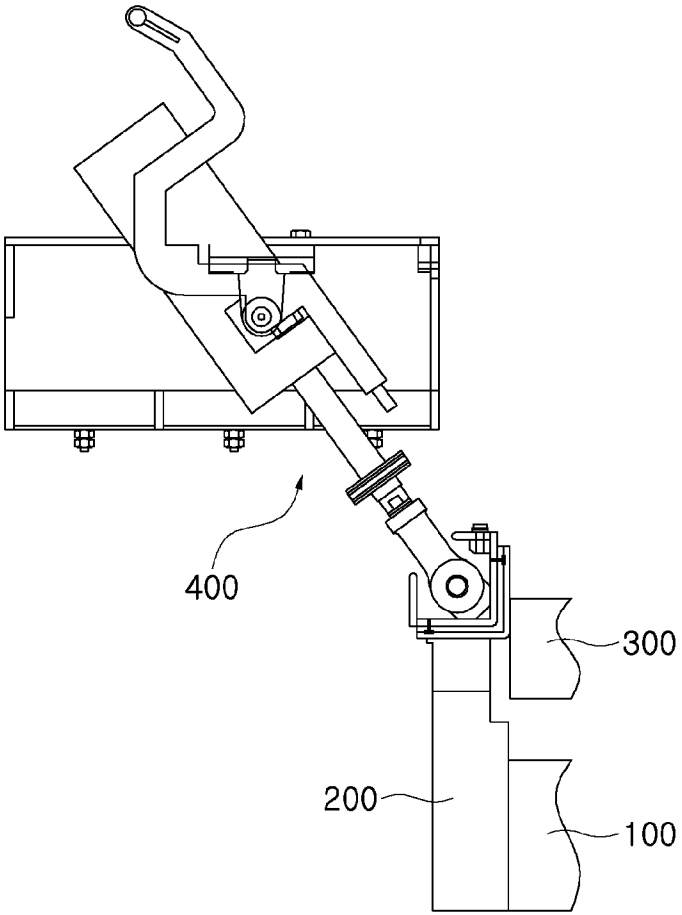

FIG. 3 is a side view illustrating an edge dam upper portion sealing apparatus according to an exemplary embodiment of the present disclosure, and FIGS. 4A and 4B are a front view and a side view illustrating a sealing pad according to an exemplary embodiment of the present disclosure. FIG. 5 is a pneumatic circuit diagram according to an exemplary embodiment of the present disclosure, and FIGS. 6A and 6B are side views illustrating the edge dam upper portion sealing apparatus moving in synchronization with movement of edge dams of a twin roll strip caster according to an exemplary embodiment of the present disclosure.

Referring to FIG. 3, the edge dam upper portion sealing apparatus 400 of the embodiment of the present disclosure may include: sealing pads 410 making tight contact with the edge dams 200 and a meniscus shield 300 of the twin roll strip caster; bearing members 430 coupled to the sealing pads 410; and driving units 450 connected to the bearing members 430.

The twin roll strip caster may include: a pair of casting rolls 100 configured to be rotated while being cooled with cooling water; and the edge dams 200 sealing lateral sides of the casting rolls 100. The meniscus shield 300 may be disposed on top of a molten steel pool formed by the casting rolls 100 and the edge dams 200, so as to block ambient air and thus to prevent molten steel contained in the molten pool from being oxidized by contact with ambient air.

If air is introduced through gaps between the edge dams 200 and the meniscus shield 300, oxides may be formed on the surface of molten steel and may be included in a strip to worsen the quality of edge portions of the strip.

Therefore, according to the embodiment of the present disclosure, the edge dam upper portion sealing apparatus 400 for the twin roll strip caster may be brought into tight contact with the edge dams 200 and the meniscus shield 300 to seal the gaps between the edge dams 200 and the meniscus shield 300.

To this end, the edge dam upper portion sealing apparatus 400 of the embodiment of the present disclosure may include the sealing pads 410, and the sealing pads 410 may be brought into tight contact with the upper portions of the edge dams 200 and lateral sides of the meniscus shield 300 for sealing the gaps between the edge dams 200 and the meniscus shield 300.

The sealing pad 410 may be coupled to the bearing members 430. The bearing members 430 may be connected to the driving units 450, each being coupled to at least two links 451 and 453 for forming a link structure. The driving units 450 may be pneumatic cylinders having a simple structure and durability under a high-temperature environment.

Referring to FIG. 5, air may be supplied to the driving units 450 at a constant pressure through a regulator 500, and the driving units 450 may apply constant loads to the sealing pads 410 without using an electrical control unit.

Therefore, since loads are transmitted to the sealing pads 410 through the bearing members 430 by the operations of the driving units 450, the sealing pads 410 may be brought into tight contact with the upper portions of the edge dams 200 and the lateral sides of the meniscus shield 300.

In addition, since the driving units 450 and the bearing members 430 are connected to form link structures, the sealing pads 410 indirectly connected to the driving units 450 through the bearing members 430 may maintain tight contact with the edge dams 200 and the meniscus shield 300 even though the edge dams 200 are shaken.

That is, the bearing members 430 and the driving units 450 may form link structures, and as shown in FIGS. 6A and 6B, the driving units 450 may be moved in synchronization with continuous motions of the edge dams 200. Therefore, loads generated by the operations of the driving units 450 may be transmitted to the sealing pads 410 without any structural interference.

The bearing members 430 may include spherical bearings and angles 431 having a shape corresponding to the sealing pads 410 for fixing the sealing pads 410.

The sealing pads 410 may have an L-shape for making tight contact with the upper portions of the edge dams 200 and the lateral sides of the meniscus shield 300.

Referring to FIGS. 4A and 4B, each of the sealing pads 410 may be formed by attaching two heat-resistant members 411 to each other, disposing support plates 413 each having at least one hole 413*a* between the heat-resistant members 411, and coupling wires 415 to the holes 413*a* of the support plates 413 through one of the heat-resistant members 411.

The heat-resistant members 411 may be formed of a material having a high degree of heat resistance such as ceramic wool, mineral wool, or glass wool.

Ends of the wires 415 may be coupled to the holes 413*a* formed in the support plates 413, and the other ends of the wires 415 may be exposed externally from the heat-resistant members 411.

The other ends of the wires 415 may be coupled to the angle 431 of the bearing member 430 to bring the sealing pad 410 into tight contact with the angle 431.

In this way, the sealing pads 410 may be brought into tight contact with the angles 431, and although the edge dams 200 are continuously moved, the sealing pads 410 may not be separated or deformed.

In addition, each of the sealing pads 410 may further include heat-resistant fiber 417 surrounding outer surfaces of the two heat-resistant members 411.

As set forth above, according to the exemplary embodiments of the present disclosure, the edge dam upper portion sealing apparatus for a twin roll strip caster is configured to apply constant loads to the upper portions of the edge dams while moving in synchronization with continuous movements of the edge dams so as to seal gaps between the edge dams and the meniscus shield without applying excessive force to edge dam structures. Therefore, permeation of ambient air may be prevented, and a strip having stable quality may be continuously produced.

While exemplary embodiments of the present disclosure have been shown and described above, it will be apparent to those skilled in the art that modification and variations could be made without departing from the scope of the present invention as defined by the appended claims.

What is claimed is:

1. An edge dam upper portion sealing apparatus for a twin roll strip caster, the edge dam upper portion sealing apparatus comprising:

a sealing pad making tight contact with an upper portion of an edge dam and a lateral side of a meniscus shield of the twin roll strip caster;

a bearing member coupled to the sealing pad; and a driving unit connected to the bearing member and coupled to at least two links for forming a link structure.

2. The edge dam upper portion sealing apparatus of claim 1, wherein the bearing member comprises:

a spherical bearing; and an angle having a shape corresponding to the sealing pad for fixing the sealing pad.

3. The edge dam upper portion sealing apparatus of claim 1, wherein the driving unit and the bearing member are coupled to each other to form the link structure.

4. The edge dam upper portion sealing apparatus of claim 1, wherein the sealing pad seals a gap between the edge dam and the meniscus shield.

5. The edge dam upper portion sealing apparatus of claim 1, wherein the sealing pad further comprises heat-resistant fibers surrounding outer surfaces of the two heat-resistant members.

6. The edge dam upper portion sealing apparatus of claim 1, wherein the other end of the wire is coupled to an angle of the bearing member, and the sealing pad is brought into tight contact with the angle.

* * * * *